United States Patent [19]

Buchegger et al.

[11] Patent Number: 4,608,014

[45] Date of Patent: Aug. 26, 1986

[54] COILER-FURNACE UNIT

[75] Inventors: Rudolf Buchegger, St. Florian; Franz Hirschmanner, Leonding, both of Austria

[73] Assignee: Voest-Alpine Aktiengesellschaft, Linz, Austria

[21] Appl. No.: 742,034

[22] Filed: Jun. 6, 1985

[30] Foreign Application Priority Data

Jun. 18, 1984 [AT] Austria ..... 1970/84

[51] Int. Cl.[4] ..... F27B 9/28; C21D 9/52; F27D 7/00; F27D 23/00

[52] U.S. Cl. ..... 432/59; 266/102; 432/65; 432/249

[58] Field of Search ..... 432/65, 249, 59; 266/102, 103

[56] References Cited

U.S. PATENT DOCUMENTS 2,646,231 7/1953 Frielinghaus ..... 432/59
4,452,587 6/1984 Laws et al. ..... 432/65

FOREIGN PATENT DOCUMENTS 370776 9/1982 Austria .
370777 9/1982 Austria .
373290 5/1983 Austria .
424894 9/1974 U.S.S.R. ..... 432/65

*Primary Examiner*—John J. Camby
*Attorney, Agent, or Firm*—Kurt Kelman

[57] ABSTRACT

A coiler-furnace unit comprises a coiler having a heatable coiler mandrel, which is disposed in a heat insulating housing, and strip guiding means comprising pressure applying rollers for engaging a strip to be coiled at least two cylindrical guide shoes, which extend around and are engageable with the coiler mandrel. In order to avoid heat losses, at least one heat insulating shielding element is provided, which is adapted to be introduced into the annular clearance defined on one side by the guide shoes when they have been retracted from the coiler mandrel and by the pressure-applying rollers and on the other side by the coiler mandrel or the strip coiled on said mandrel.

10 Claims, 2 Drawing Figures

COILER-FURNACE UNIT

BACKGROUND OF THE INVENTION

1. Field of the Invention

This invention relates to a coiler-furnace unit comprising a coiler having a heatable coiler mandrel, which is disposed in a heat insulating housing, strip guiding means comprising pressure applying rollers for engaging a strip to be coiled and at least two cylindrical guide shoes extending, around and engageable with the coiler mandrel.

2. Description of the Prior Art

In order to reheat a strip to be rolled to a temperature which is sufficient for the rolling operation, coiler-furnace units for reheating the strip to a sufficiently high temperature are provided before and behind the reversing stands of a hot rolling plant. Austrian Pat. No. 370,776 discloses a strip guiding means for assisting the coiling of the strip in the coiler-furnace unit on the collar mandrel, which is disposed in a heat insulating housing. The strip guiding means comprises pressure applying rollers for engaging the strip to be coiled as well as two cylindrical guide shoes, which extend around the coiler mandrel and are secured to rockers. The rockers extend outside the heat insulating housing and are pivoted on axes which are parallel to the coiler mandrel. The rockers are operable to move the guide shoes into engagement with the coiler mandrel from opposite sides. As a result, the leading end of the strip, which has been introduced into the coiler-furnace unit over a strip guiding bridge, is forced against the coiler mandrel by the pressure applying rollers and is guided around the coiler mandrel by the guide shoes. The strip coiled on the coiler mandrel may be heated, e.g., by hot gases, which are introduced into the heat insulating housing. But such a heating by means of hot gases will promote the formation of scale and the resulting scale will be trapped between the convolutions of the coiled strip and will subsequently be rolled into the strip. In order to avoid said disadvantage it is known from Austrian Pat. Nos. 373,290 and 370,777 to heat the coiler mandrel and to use it as a heater for heating the coiled strip so that the coiled strip being formed will be heated from the inside.

The pressure applying rollers engaging the coiled strip on the outside and the guide shoes extending around the coiled strip will be subjected to a high heat load, regardless of the manner in which the strip is heated, and will dissipate a part of the heat which is supplied. This increases the energy requirement and adversely affects the uniform heating of the coiled strip, particularly if it is heated from the coiler mandrel.

SUMMARY OF THE INVENTION

It is an object of the invention to avoid these disadvantages and so to improve a coiler-furnace unit of the kind described first hereinbefore that the coiled strip can be uniformly heated from the coiler mandrel whereas the heat losses will be minimized.

This object is accomplished in accordance with the invention by arranging at least one heat insulating shielding element adapted to be introduced into the annular clearance defined on one side by the guide shoes when they have been retracted from the coiler mandrel and by the pressure-applying rollers, and on the other side by the coiler mandrel or the strip coiled on the mandrel.

When a few convolutions of strip have been formed on the coiler mandrel, the strip guiding means are retracted from the coiler mandrel and the heat insulating shielding element is inserted between the strip being coiled and the retracted strip guiding means. As a result, the heat load on the pressure applying rollers and the guide shoes is greatly reduced because the transfer of heat from the coil to the strip guiding means by a conduction and radiation of heat is substantially inhibited. Besides, the strip guiding means can no longer dissipate heat from the coiled strip so that the coiled strip will be uniformly heated with small heat losses even in its marginal regions. The shielding element which shields the strip guiding means from the coiler mandrel will not only minimize the transfer of heat to the strip guiding means but will also confine the space which surrounds the coiled strip and can receive radiant heat.

Because it is sufficient to provide a heat insulating shielding element for covering the strip guiding means extending around the coiler mandrel, any suitable design may be adopted for the means for inserting the heat insulating shielding element into the annular clearance between the strip guiding means and the coiler mandrel. For instance, a cylindrical shielding element might be provided, which has a longitudinal slot for the passage of the strip entering the coiler-furnace unit, and such shielding element might by axially pushed over the coiler mandrel and the strip coiled on the mandrel. In that case the heat insulating housing must be formed at one end with a suitable opening through which the cylindrical shielding element can be inserted. A simpler design will be obtained within the scope of the invention if a separate shielding element is associated with each guide shoe and the shielding element is adapted to be inserted transversely to the coiler mandrel into the annular clearance between the retracted associated guide shoe and the coiler mandrel or the strip coiled on the mandrel. In such arrangement each shielding element may be platelike and, even in a retracted position, a substantial part of each shielding element may extend inside the heat insulating housing. It will be necessary only to provide proper means for movably mounting the shielding elements and for driving the shielding element into the annular clearance when the strip guiding means have been retracted.

It will be understood that the means for movably mounting and for driving the shielding elements must not obstruct the shifting of the guide shoes and of the pressure applying rollers of the strip guiding means. This requirement can be met in a simple manner by slidably mounting each shielding element on the associated guide shoe and connecting it to an actuator. Because in that case the shielding elements will necessarily follow the movement of the guide shoes and pressure applying rollers, the shifting of the guide shoes cannot be adversely affected by the shielding elements and the associated drive means. The movable mounting of the shielding elements on the guide shoes affords the further advantage that the shielding elements can be introduced into the annular clearance during the retraction of the guide shoes from the coiler mandrel so that the guide shoe will be exposed to the heat from the coiler mandrel for a shorter time.

If the guide shoes are mounted on and are adjustable by pivoted rockers, which are pivoted on axes which are parallel to the coiler mandrel, the shielding elements may be provided with particularly simple actuators consisting of a slider crank mechanism, which is operable by a lever that is pivoted to the rocker connected to the associated guide shoe or is pivoted to an arm that is operatively connected to the rocker. In such, an arrangement an adjustment of the rockers will positively drive also the slider crank mechanism by means of the lever that is pivoted to the rocker so that the shielding element will be actuated accordingly and a defined relation between the angular position of the rockers and the position of the shielding elements will be obtained. In that case, there will be no need for a separate control of the means for actuating the shielding elements.

DETAILED DESCRIPTION OF THE PREFERRED EMBODIMENT

Figure 1:
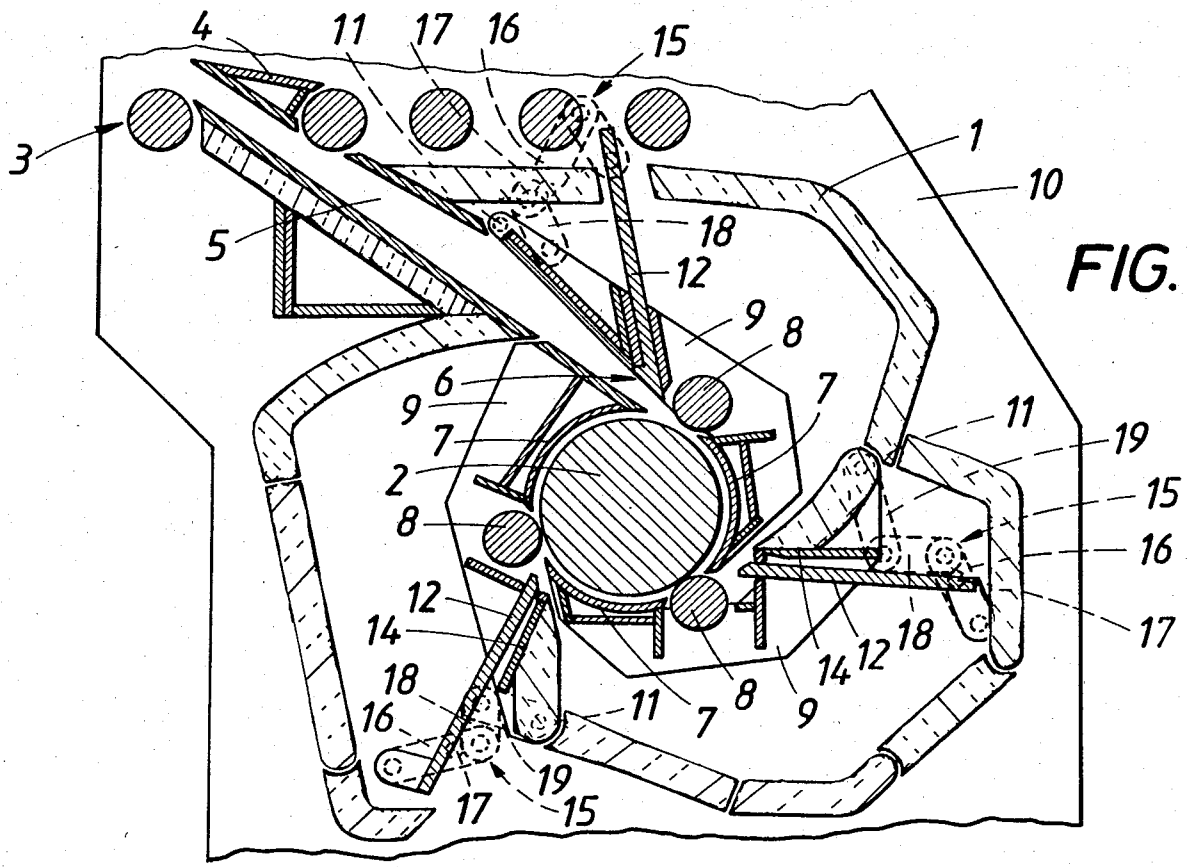
FIG. 1 is a simplified sectional view showing a coiler-furnace unit embodying the invention in a position in which the strip guiding means engages the coiler mandrel, the view being taken on a section plane extending at right angles to the coiler mandrel.

An illustrative embodiment of the invention is diagrammatically shown on the drawing.

Figure 2:
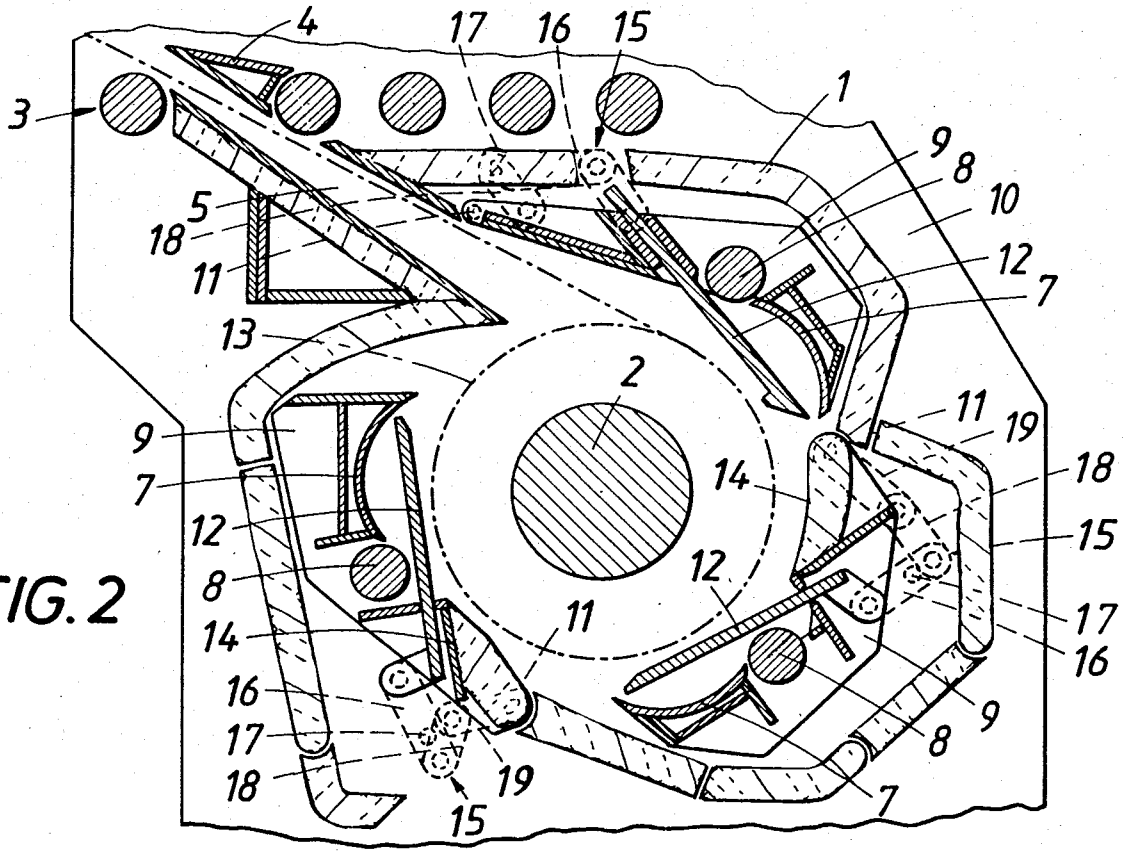
FIG. 2 is a view that is similar to FIG. 1 but shows the coiler-furnace unit when the strip guiding means has been retracted from the coiler mandrel.

The coiler-furnace unit which is illustrated comprises a heat insulating housing 1 and a coiler having a heatable mandrel 2 disposed in the housing 1. Strip to be reheated is delivered by means of a roller conveyor 3 and is deflected by a pivoted deflector 4 into an entrance passage 5 and is then engaged by strip guiding means 6, which extends around the coiler mandrel 2 (FIG. 1). In the illustrated embodiment, the strip guiding means comprises three cylindrical guide shoes spaced around the coiler mandrel 2 and three drivable pressure applying rollers associated with respective guide shoes. Each guide shoe 7 and the associated pressure applying roller 8 are mounted on a rocker 9, which is mounted on a pivot 11, mounted in the end walls 10 of the coiler-furnace unit and extending parallel to the coiler mandrel 2. The rockers 9 are suitably spaced from the coiler mandrel so that the rockers 9 are pivotally movable to move the guide shoes 7 and the pressure applying rollers 8 into engagement with the coiler mandrel so as to provide a guide for the strip to be coiled, and to retract the strip guiding means from the coiler mandrel 2 to an inoperative position, which is shown in FIG. 2 and in which the guide shoes 7 are received in pocketlike enlarged portions of the heat insulating housing 1.

To ensure that the strip coiled on the coiler mandrel 2 will be uniformly heated from the latter, heat insulating platelike shielding elements 12 are slidably mounted on the guide shoes 7 and are adapted to be displaced from the position shown in FIG. 1, in which they expose the strip guiding means 6, into an annular clearance which, after the retraction of the guide shoes 7 from the coiler mandrel 2, is defined between the latter or the coiled strip 13, indicated in phantom, and the guide shoes. As a result, the coiled strip 13 is surrounded by a heat insulated space which is defined by the advanced shielding elements 12 and the heat insulating coverings 14 provided on those surfaces of the guide shoes 7 which face the coiler mandrel 2 but do not serve to guide the strip. Owing to that heat insulated space, an unnecessary heat load on the guide shoes 7 and the pressure applying rollers 8 will be avoided and a heat dissipation, which would adversely affect the uniform heating of the coiled strip 13, will be substantially inhibited.

The shielding elements 12 can be actuated by actuators 15, which may be of any of numerous different types. In order to permit a positive mechanical control of the actuators 15, they may consist of slider crank mechanism 16 having a crank in the form of a two-armed lever mounted on a pivot 17, which is mounted in the end walls 10 of the coiler-furnace unit. By means of a lever 18 the crank is pivoted to the rocker 9 for actuating the associated guide shoe 7, or to an arm 19 that is operatively connected to that rocker 9. A pivotal movement of the rockers 9 will positively actuate the slider crank mechanism 16 so that the position of the shielding elements 12 will be related to the angular position of the rockers 9.

We claim:

1. In a coiler-furnace unit comprising a heat insulating housing, a heatable coiler mandrel extending in said housing, and strip guiding means disposed in said housing around said mandrel and adapted to guide a strip to be coiled on, and heated by said mandrel, said strip guiding means comprising a plurality of pressure applying rollers for urging said strip against said mandrel and cylindrical guide shoes angularly spaced apart around said mandrel, said rollers and shoes being engageable with said strip coiled around said mandrel and retractable from said mandrel to define an annular clearance with said coiled strip, wherein the improvement comprises heat insulating shielding means adapted to be moved into and out of said annular clearance.

2. The improvement set forth in claim 1, wherein said heat insulating shielding means comprises a plurality of shielding elements associated with respective ones of said guide shoes and movable transversely to the axis of said mandrel to a shielding position in which each of said shielding elements extends between the associated guide shoe and said mandrel.

3. The improvement set forth in claim 2 wherein each of said pressure applying rollers is located adjacent to one of said guide shoes, and each of said shielding elements is movable to and from a shielding position in which said shielding element shields the associated guide shoe and the adjacent pressure applying roller against radiant heat from said coiled strip.

4. The improvement set forth in claim 3, wherein each of said heat shielding elements is movable from said shielding position to a non-shielding position, in which at least a major portion of each of said shielding element is still disposed in said heat insulating housing and said pressure applying rollers and said guide shoes are exposed to said coiler mandrel.

5. The improvement set forth in claim 2, wherein each of said shielding elements is slidably mounted on the associated guide shoe, and further comprising actuating means for moving said shielding elements relative to said guide shoes to and from said shielding position.

6. The improvement set forth in claim 5, in which said guide shoes are mounted on rockers pivoted on axes which are parallel to the axis of said mandrel, and wherein said actuating means comprises for each of said shielding elements a slider crank mechanism and a lever operatively connecting said mechanism to the rocker on which the associated guide shoe is mounted.

7. The improvement set forth in claim 6, wherein said lever is pivoted to said rocker.

8. The improvement set forth in claim 6, wherein an arm is operatively connected to each of said rockers and each of said levers is pivoted to one of said arms.

9. The improvement set forth in claim 1, wherein said heat insulating shielding means is movable to and from a shielding position in which it shields said rollers and guide shoes against radiant heat form said coiled strip.

10. The improvement set forth in claim 9, wherein said heat insulating shielding means is movable from said shielding position to a non-shielding position, in which a major part of said shielding means is still disposed in said heat insulating housing and said pressure applying rollers and said guide shoes are exposed to said coiler mandrel.

* * * * *